United States Patent [19]

Sauvey et al.

[11] 4,128,036

[45] Dec. 5, 1978

[54] ELECTRO-MECHANICAL KEYBOARD MEMORY FOR AN ELECTRONIC MUSICAL INSTRUMENT

[75] Inventors: Donald R. Sauvey, Palatine; Robert E. Magnuson, Mt. Prospect, both of Ill.

[73] Assignee: Hammond Corporation, Chicago, Ill.

[21] Appl. No.: 724,166

[22] Filed: Sep. 17, 1976

[51] Int. Cl.[2] ..... G10C 3/12

[52] U.S. Cl. ..... 84/441; 84/1.17; 84/423; 84/1.03

[58] Field of Search ..... 84/423, 424, 425, 443, 84/442, 1.01, 1.17, DIG. 22, DIG. 7, 1.03, DIG. 25, 369, 345, 441; 200/327, 325, 318, 50 C, 5 E; 35/5; 340/337; 235/27, 130

[56] References Cited

U.S. PATENT DOCUMENTS

| | | | |
|---|---|---|---|
| 131,090 | 9/1872 | Fowler | 84/441 |
| 199,795 | 1/1878 | Clarke | 84/369 |
| 361,949 | 4/1887 | Kelly | 84/441 |
| 818,539 | 4/1906 | Howard | 84/441 |
| 873,364 | 12/1907 | Funkhouser | 84/345 |
| 1,068,010 | 7/1913 | Severy et al. | 84/441 |
| 2,121,262 | 6/1936 | Riesmeyer | 84/441 |
| 2,187,999 | 1/1940 | Dezso | 84/441 |
| 2,626,325 | 1/1953 | Hammond et al. | 200/5 E |
| 2,935,577 | 5/1960 | Damke et al. | 200/5 E |
| 3,585,893 | 6/1971 | Arseneault | 84/DIG. 25 |
| 3,708,602 | 1/1973 | Hiyama | 84/1.03 |

*Primary Examiner*—Ulysses Weldon
*Attorney, Agent, or Firm*—John J. McArdle, Jr.

[57] ABSTRACT

In a keyboard electronic musical instrument such as an electronic organ, an electro-mechanical memory device for holding in the down or actuated position one or more simultaneously depressed accompaniment chord and bass playing keys after the finger pressure from the instrument player is removed. The signal representing the note or chord associated with the depressed key or keys is sustained as long as the keys remain latched down. A plurality of keys of the lower or accompaniment manual are adapted to be retained in the depressed position and operate as part of the electro-mechanical memory device. When a key or group of keys are latched down, the depression by the instrument player of another key releases the previously retained keys but the newly depressed key is latched down. The electro-mechanical memory also operates in conjunction with the touch mode of the automatic rhythm unit to provide a rhythm signal when the accompaniment keys are retained in the depressed position. The organ keyboard functions in the standard manner when the electro-mechanical memory is deactivated.

4 Claims, 5 Drawing Figures

ELECTRO-MECHANICAL KEYBOARD MEMORY FOR AN ELECTRONIC MUSICAL INSTRUMENT

BACKGROUND OF THE INVENTION

The present invention is directed to an electro-mechanical device which makes a keyboard electronic musical instrument such as a electronic organ easier to play. In the standard two manual electronic organ, the lower or accompaniment manual is used for playing chords and bass notes and the upper or solo manual is used for playing the melody. The tone output from a standard organ is sustained in a well-known manner as long as the keys associated with the tone remain depressed. The instant invention is an electro-mechanical memory device for retaining accompaniment keys in the depressed position after the fingers of the instrument player are removed. The note or chord associated with the depressed key or keys is sustained until the instrument player either depresses another accompaniment key or deactivates the entire memory which causes the release of the keys previously held down. The electro-mechanical retention of the keys in the depressed position frees the left hand of the organist for performing other musical functions such as playing on the solo manual. The organist can correlate the tone signal output of the organ with the specific combination of keys held in the depressed position by the electro-mechanical memory and thereby easily determine the note or chord being played. Furthermore, the relationship between the keys forming the various chords can be visually observed by the beginning organist.

The use of a mechanical device to hold down a non-note playing key is well-known in the electronic organ field. Organs made by Hammond Corporation, assignee of the present invention, employ non-note playing preset keys which upon depression by the instrument player are locked in the down position. Such non-note playing preset keys are currently used on a number of Hammond Corporation organs; however, the preset keys are not note playing keys and provide an entirely different and distinct function from the electro-mechanical memory device of the present invention.

A note played on a manual of an electronic organ consists of a fundamental pitch and a number of multiples of the fundamental frequency called harmonics. The combination of fundamental and harmonics available by depressing a playing key on the type of organ having these non-note playing preset keys is controlled by means of draw bars. The draw bars are mounted on the organ console and are movable by the instrument player to provide a mixture of the fundamental and the different harmonics. By adjusting the draw bars to different positions, the instrument player may vary the tone colors available from each playing key. Mounted on the organ console adjacent the lower manual on this type of electronic organ are these plurality of preset keys approximately nine in number which are opposite in color but similar in structural appearance to the playing keys.

Each preset key operates as a switch to make available a different tone color output signal, combination of fundamental frequency and harmonics, in the same manner as the manual adjustment of the draw bars. Each preset key corresponds to a predetermined combination of draw bar positions and depressing a preset key selects a prewired circuit on a panel located inside the organ console which electrically simulates a predetermined combination of draw bars. Only a single preset key is depressed at any one moment and it controls the combination or mix of the fundamental and the various harmonics available when the instrument player depresses the playing keys. Thus the depression of a single preset key automatically provides the instrument player with a prearranged combination of draw bar positions and is a substitute for manually positioning the draw bars. The latching mechanism of the preset keys while retaining a preset key in the depressed position is used by the instrument player for an entirely different function than the present invention.

SUMMARY OF THE INVENTION

The present invention is an electro-mechanical memory device for a keyboard electronic musical instrument such as an electronic organ. A plurality of playing keys on the lower manual or the accompaniment portion of a single manual organ operate with the electro-mechanical memory and are adapted to be retained in the depressed position. The tone signal output of the organ representing the note or chord corresponding to the depressed key or keys is sustained as long as the keys remain latched down. It should be understood that when the automatic rhythm unit of an electronic organ is operative, the term sustain has a more complicated meaning. When the rhythm unit is operating, the tone signal output is actually modulated or interrupted at the rhythmic beat. This interruption is accomplished, as is well-known, by either chopping the bus voltage supplied to the key contacts or chopping the keyer output voltage. The term sustain as used herein includes this more complex meaning.

A contact leg is attached to the bottom of each cooperating key of the accompaniment manual. A latching mechanism is mounted underneath the accompaniment keys with leg members. A pivotable bar assembly of the latching mechanism extends transversely beneath the contact leg member of each key so that when a key is depressed the leg member contacts the bar assembly causing it to momentarily swing out of the downward path of the leg member. The bar assembly returns to its normal position under the influence of a bias spring within a sufficient period of time to capture the leg member in its downward position retaining the accompaniment chord and bass note playing key in the depressed position. The subsequent depression of another accompaniment key causes its leg member to contact the bar assembly which momentarily pivots and releases ally keys previously retained. The bar assembly again returns to its normal position and captures the leg member of the recently depressed key in the down position.

If the instrument player does not desire to use the electro-mechanical memory, a control means coupled to the bar assembly causes it to pivot and remain out of the downward path of the leg members. The accompaniment keyboard of the organ then operates in the standard manner with a depressed key returning to its normal horizontal position after the pressure from the instrument player's finger is removed. The electro-mechanical memory also operates in conjunction with the touch mode of the rhythm unit to provide rhythm signals when the accompaniment keys are retained in the depressed position.

An object of the present invention is to provide an electro-mechanical memory for retaining a depressed accompaniment chord and bass note playing key in the down position after the pressure from the instrument player's finger is removed providing a sustained tone signal output as long as the key remains depressed.

Another object is to provide an electro-mechanical memory for a keyboard electronic musical instrument which can be deactivated so that the keyboard operates in the standard manner.

A further object is to provide an electro-mechanical memory cooperating with the touch mode of a rhythm unit of an electronic organ for providing a rhythm signal when any accompaniment chord and bass note playing key is latched in a depressed position.

A further object is to provide an electro-mechanical memory for visually illustrating to instrument players the physical position of notes and chords on the accompaniment keyboard and the physical interrelationship between the various musical notes and chords.

A further object is to provide an electro-mechanical memory for making the electronic organ easier to play for the experienced organist.

A further object is to provide an electro-mechanical memory for making the learning of musical chords easier for the beginning organist.

BRIEF DESCRIPTION OF THE DRAWINGS

Further additional objects will appear from the following detailed description of the specific embodiment made in conjunction with the accompanying drawings, wherein.

DETAILED DESCRIPTION

Figure 1:
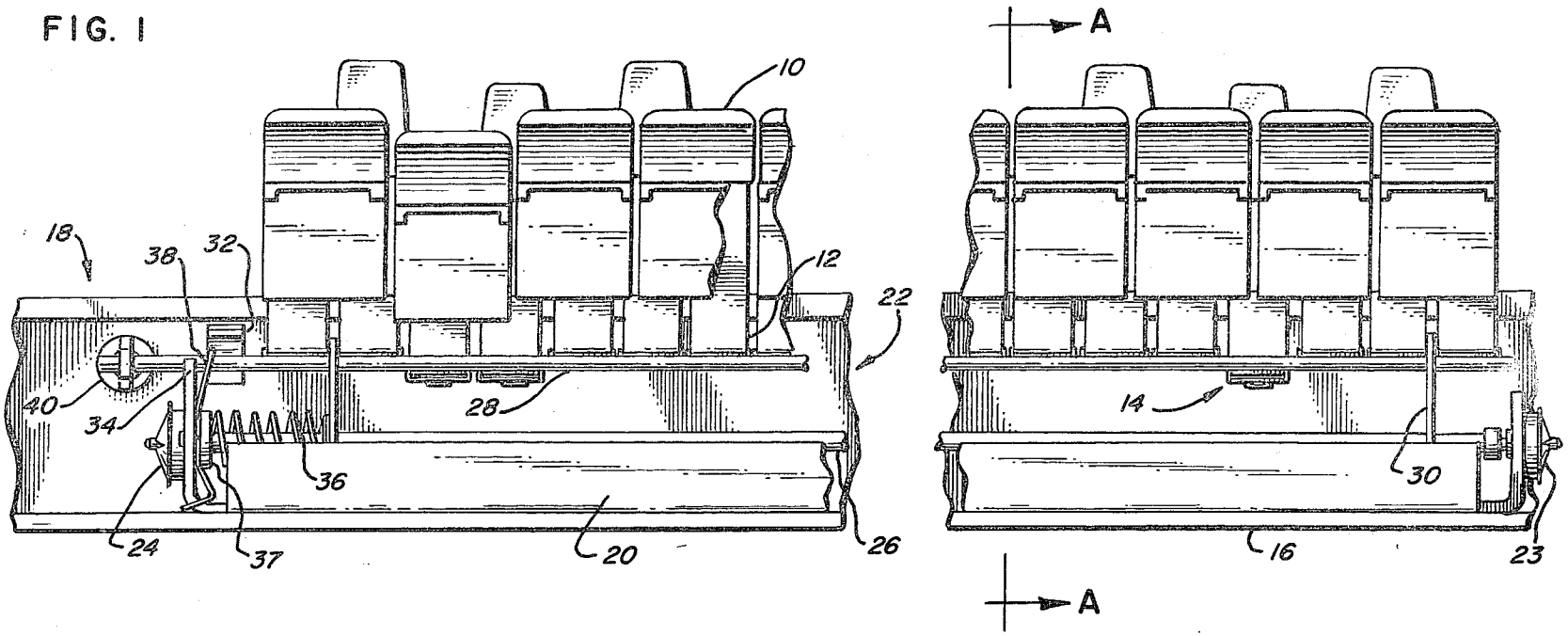
FIG. 1 is a front view of the electro-mechanical memory of the present invention with several accompaniment playing keys latched in the depressed position.

FIG. 1 is a front view of an organ keyboard with the cabinet and other unnecessary portions of the organ removed to facilitate the illustration of the electro-mechanical memory of the present invention. A plurality of organ keys 10 of the accompaniment or lower manual of an electronic organ are shown. The keys 10 are standard organ keys which are spring loaded to return to their quiescent or horizontal position after the force exerted by the instrument player's finger is removed. A plurality of the keys of the accompaniment manual are adapted to operate as part of the electro-mechanical memory. It should be noted that the number of keys which operate with the memory device can be varied but in the preferred embodiment, the first 20 keys starting an octave below middle C form a portion of the electro-mechanical memory. A bracket 12 is attached by any convenient and well-known means to the bottom side of the key 10 as is best illustrated in FIGS. 2 through 5. The bracket 12 extends downward from the key bottom and terminates at free end 13. Attached to the downwardly projecting free end 13 of bracket 12 at a substantially perpendicular angle is tongue assembly 14. The tongue assembly 14 extends horizontally towards the front of the keys 10 or towards the instrument player in the normal playing position.

Mounted on the organ frame 16 substantially beneath and transverse to the downward path traveled by any depressed key is the latching mechanism generally indicated at 18. The latching mechanism comprises a housing or frame 20 which is secured by any convenient and well-known means to the organ frame 16 and bar assemblage 22. The bar assemblage 22 is pivotally mounted to the side walls of frame 20 by bushings 23 and 24 or any other means which permits the bar assemblage 22 to rotate or pivot.

The bar assemblage 22 comprises a lower stationary rod or bar 26 and an upper swing rod or bar 28 and connecting or support arms 30. The swing rod 28 is positioned above and slightly in front of stationary rod 26 by support arms 30. As the stationary rod 26 rotates in the support bushings 23 and 24, the swing rod 28 moves from an extreme rear position to an extreme forward position. The extreme rear or back position of swing rod 28 is limited by stop element 32 and a plane intersecting the rods 26 and 28 in this position would form an angle of approximately 20° from the perpendicular. The extreme forward position of swing rod 28 is limited by abutment 34 and a plane intersecting the rods 26 and 28 in this position would form an angle of approximately 30° from the perpendicular. A compression coil spring 36 is wound about the left-hand portion of stationary rod 26 to eliminate undesirable end movement of the bar assemblage 22 in conjunction with bushings 23 and 24. A pin or shoulder 37 is secured to the side wall of frame 20. A hairpin torsion spring 38 is secured to pin 37 and is biased against the swing rod 28. The biasing pressure that is provided by the torsion spring 38 forces the swing rod 28 to its fully extended rear position in contact with stop element 32.

A control means 40 is mounted on a portion of the organ frame 16 and is connected to the left terminal portion of swing rod 28. The control means 40 is a bistable device such as a solenoid. In the first position, the solenoid overcomes the biasing pressure of the torsion spring 38 against swing rod 28 and forces the rod 28 to its fully extended forward position against abutment 34. In its second position, the control means 40 releases its force against swing rod 28. Without the forward force of the control means 40 the rod 28 under the pressure of the bias torsion spring 38 returns to its fully extended back position against stop element 32. When the control means 40 is in the second position, the swing rod 28 is positioned in the downward path of the horizontal tongue 14. In this position the electro-mechanical memory is activated and the depression of a key 10 by the instrument player will cause the tongue portion 14 to latch beneath the swing or retention rod 28 as illustrated in FIG. 1. When the control means 40 is in the first position, the rod 28 is moved out of the downward path of the tongue 14 and the keys 10 associated with the memory operate in their normal manner.

Figure 2:
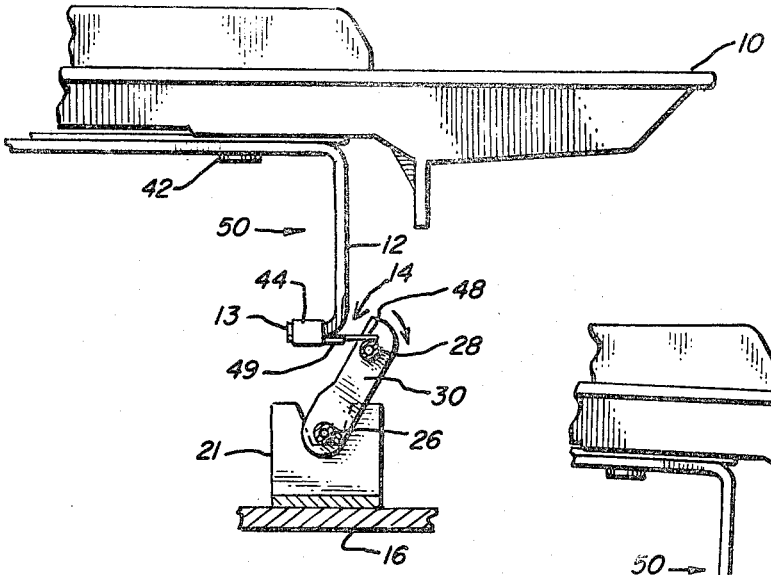
FIG. 2 is a side view along line A—A of an accompaniment playing key in the quiescent position and the electro-mechanical memory activated.

FIG. 2 is a side view along line A—A of FIG. 1. The same numerals are used to identify identical structural elements in all of the figures. The organ key 10 is shown in its quiescent or horizontal position. The downwardly extending bracket 12 is attached to the key 10 at point 42 by any standard means. The tongue 14 is secured to the downwardly projected free end 13 of bracket 12 by fastener 44. The tongue 14 comprises two flexible members, the long flexible lip element 48 and the shorter and more rigid shelf 49. The flexible lip 48 is positioned on top of shelf 49 and extends forward beyond the termination of shelf 49. The flexible lip 48 is the element of tongue 14 which contacts the swing rod 28.

In the position illustrated in FIG. 2, the latching mechanism 18 is in the activated mode so that the swing rod 28 is biased to a position directly in the downward path of the contact leg assembly 50 comprising bracket 12 and tongue 14. The bar assemblage 22 is confined within the V-shaped notch guide section 21 of the frame 20. As the key 10 is depressed by the instrument player the lip portion 48 of tongue 14 contacts swing rod 28 and momentarily pivots the rod 28 out of the downward path of the contact leg 50. Since the bar assemblage 22 is pivotable about the axis of rod 26, the swing rod 28 will move in the forward and slightly downward direction as illustrated by the arrow. However, since the rod 28 is biased in the back or rear direction by the torsion spring 38 as shown in FIG. 1, the bar assembly will rapidly return to the position shown in FIG. 2 as soon as the tongue 14 loses contact and moves below swing rod 28.

Figure 3:
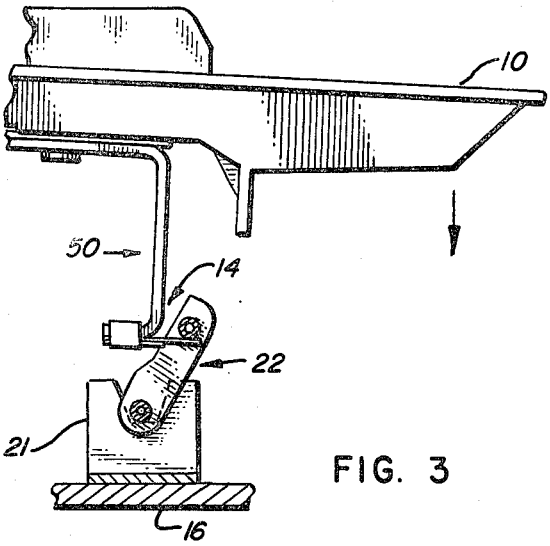
FIG. 3 is a side view along line A—A of an accompaniment playing key in the latched position and the electro-mechanical memory activated.

The return of rod 28 under the pressure of spring 38 is rapid enough to catch the tongue 14 below the rod 28 before the upward return travel of the key is completed as shown in FIG. 3. The shelf 49 of tongue 14 provides additional rigidity to the tongue 14 as it is forced against the bottom portion of rod 28. Thus, the tendency of the key 10 to return to its horizontal position is overcome and the key remains in the depressed position and the tone signal associated with the latched key is sustained.

With one or a plurality of keys 10 latched in the depressed position as illustrated in FIG. 3, the depression of an additional key by the instrument player operates to release all previously depressed keys. The operation of the latching mechanism 18 is identical to that described above with respect to FIG. 2 except that the rod 28 as it is momentarily pivoted by the depression of a new key releases its engagement with the tongue 14 of all previously depressed keys and these keys return under their normal tendency to the horizontal position. However, the rod 28 returns from its momentarily displaced position to capture the tongue 14 of the newly depressed key as described above and to retain the key in the depressed position.

Figure 5:
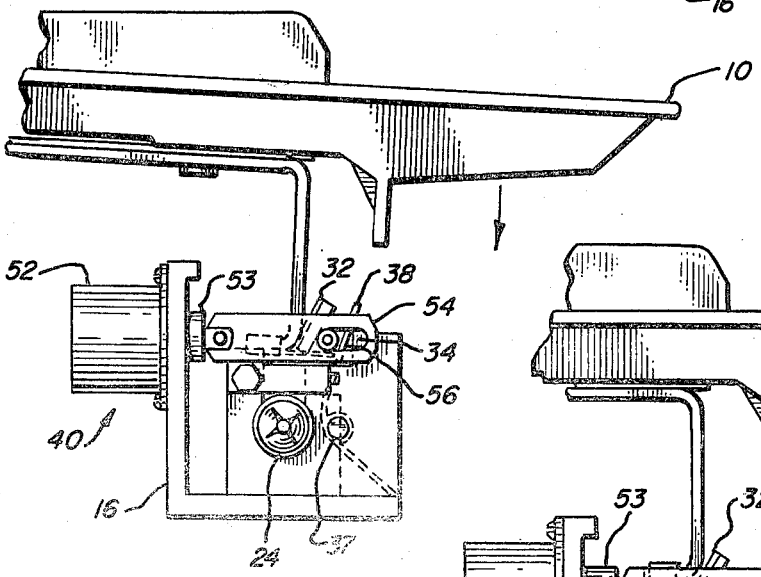
FIG. 5 is a side view of the electro-mechanical memory in the activated mode and an accompaniment playing key in the latched position.
Figure 4:
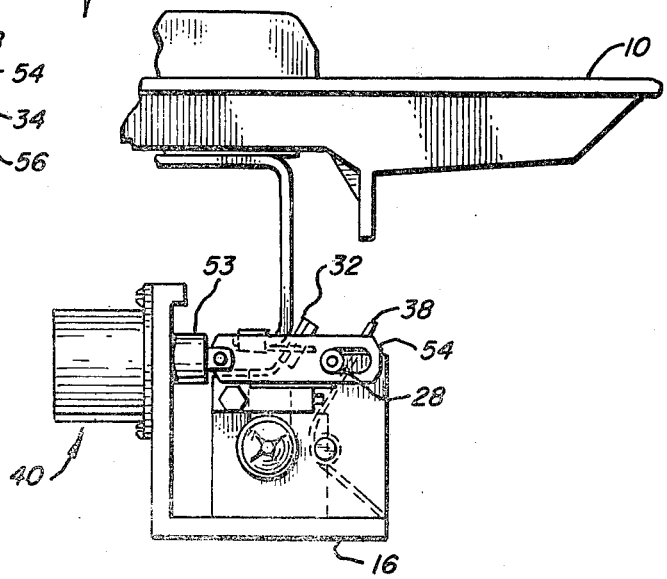
FIG. 4 is a side view of the electro-mechanical memory in the deactivated mode and an accompaniment playing key in the quiescent position.

FIGS. 4 and 5 are side views of the electro-mechanical memory of the present invention in its unactivated and activated modes, respectively. The control means 40 comprises a bistable device such as solenoid 52. A link 54 is pivotally hinged to the extending arm 53 of the solenoid 52. The solenoid 52 is mounted on a portion of the organ frame 16. The link 54 has an elongated aperture 56. The left distal end of swing rod 28 extends through the aperture 56. When the instrument player does not desire to have the electro-mechanical memory operative, the player operates the control means 40 by a switch (not shown) or by any other well-known means and the arm 53 of solenoid 52 is moved in the forward direction causing the arm 53 to exert a forward force against the swing rod 28. The forward force exerted by the control means 40 is sufficient to overcome the biasing pressure of spring 38 and the swing rod 28 is forced to the extreme forward position against abutment 34. In this extreme forward position the swing arm 28 is outside of the downward path of the contact leg 50 and the accompaniment keys operate in the standard manner as illustrated in FIG. 4.

If the instrument player desires to utilize the electro-mechanical memory, the control means 40 is operated to retract the arm 53 of solenoid 52. The forward pressure previously exerted on rod 28 by the arm 53 is released. The rod 28 now under the backward directional force of the torsion spring portion 38 is positioned in the extreme back position against stop element 32. In this extreme back position an electro-mechanical memory is active and the rod 28 is in the path of the contact leg 50. In the activated position as illustrated in FIG. 5, the rod 28 will capture the tongue portion 14 of depressed keys 10 in the same manner as described above.

If the keys 10 are held in the depressed position and the instrument player desires to release all the keys without retaining a new key in the despressed position, the control means is operated to extend arm 53 of solenoid 52 to the forward position as shown in FIG. 4. The movement of swing rod 28 to the extreme forward position releases all keys previously held in the depressed or down position. As an alternative embodiment not illustrated, one playing key of the accompaniment keyboard or an additional key added to or adjacent the accompaniment keyboard which does not produce a musical tone signal output is provided (not illustrated). This release key is identical in structure to the accompaniment key 10 described above with the exception that shelf 49 of the tongue 14 is eliminated. The downward movement of this release key causes the swing rod 28 to momentarily move out of its extreme back or latching position and release all previously held down keys. The swing rod 28 returns in adequate time to capture the tongue 14 below the rod 28, however, the normal upward force of the release key is sufficient since tongue 14 does not have the stiffening shelf 49 to again cause rod 28 to momentarily pivot out of position to permit the release key to rise to the horizontal position. The tongue portion 14 of the release key will therefore only comprise the flexible lip 48 which is not sufficiently rigid to be secured below the swing rod 28. An additional alternative release key to shelf 49 is extended horizontally beyond rod 28 and lip 48 is eliminated. The shelf 49 moves rod 28 to the forward position.

When the electro-mechanical memory of the present invention is activated the organist may play a bass note or a chord with his left hand on the accompaniment manual and the memory retains in the depressed position the key or keys played until released. The release of a depressed and retained down key is accomplished by subsequently depressing another accompaniment key or by de-energizing the entire memory. If the organist plays a chord with his left hand, the electro-mechanical memory retains the accompaniment keys in the depressed position and the tone signal associated with the chord played is sustained as long as the keys remain depressed. The organist may now use his left hand to perform other musical playing operations such as playing melody on the solo manual with both his right and left hands. The organist without an electro-mechanical memory to retain the keys in the depressed position is required to dedicate his left hand to the playing of chords and bass notes on the accompaniment keys.

An additional function of the electro-mechanical memory is the cooperation with the automatic feature of the modern electronic organ such as the automatic rhythm unit. The automatic rhythm unit is a standard well-known feature in the electronic organ art and it commonly provides a rhythmic accompaniment signal in any one of a plurality of predetermined patterns. In the touch mode the automatic rhythm unit will only provide its rhythmic accompaniment signal during the time interval in which at least one accompaniment key is depressed. It is extremely difficult and requires precise timing and manual dexterity for the organist to always maintain a key or a chord depressed on the accompaniment manual when the organist is changing to a new chord. During the moment of change if the organist does not maintain at least one key on the accompaniment manual in the depressed condition, there will be a gap in the rhythmic accompaniment. The use of the electro-mechanical memory of the present invention eliminates the necessity for precise timing in chord changes when the rhythm unit is operating in the touch mode, since the accompaniment keys forming the chord presently being played are not released from their depressed condition until a subsequent accompaniment key or group of keys are depressed. Thus, it is apparent that the electro-mechanical memory of the present invention uniquely cooperates with the rhythm unit operating in the touch mode to make the organ easier to play.

When the electro-mechanical memory is operating and the organist depresses a group of accompaniment keys forming a chord or a single note accompaniment key, the depressed keys are retained in the down position and the tone associated with the depressed keys is sustained until the keys are released. The organist can either during actual playing of a musical piece or during a practice or learning session depress a note key or a group of keys forming a chord and correlate the tone signal produced with the accompaniment keys depressed. Thus, during the playing of a musical piece the organist can readily determine the chord actually being played by the physical position of the accompaniment keys. During a practice or learning session the organist can familiarize and correlate the audible tone produced by the organ with the position of the accompaniment keys for individual notes and chords. Furthermore, the physical interrelation between various musical chords is emphasized and clarified by the use of the electro-mechanical memory of the present invention. If the organist presses the C, E and G note accompaniment keys to play a C major chord and the electro-mechanical memory retains the keys in the depressed condition, the organist can physically associate and tactilely experience the change to a C minor chord with the C, E flat G note accompaniment keys depressed. Thus, the beginning organist can easily memorize the proper location of the various musical chords and their interrelation. The learning organist can tactilely and visually experience the proper key depression for various chords by following a teacher's proper depression of the appropriate keys which are retained in the depressed position by the electro-mechanical memory.

It is to be understood that the present disclosure can be modified or varied by applying current knowledge without departing from the spirit and scope of the novel concept of the invention.

I claim:

1. An electro-mechanical memory device for use in a keyboard electronic musical instrument having a plurality of accompaniment chord and bass note playing keys and a plurality of melody playing keys both depressible by an instrument player and returnable to a horizontal position after the downward pressure from said instrument player is removed comprising:

at least 20 contact leg members each attached to the bottom of a different one of said accompaniment playing keys and extending downward therefrom;

a lower stationary bar rotatably mounted below said accompaniment playing keys;

a plurality of support arms spaced apart and attached to said stationary bar and extending upwardly therefrom;

an upper retention rod attached to said support arms and extending parallel to said stationary bar, said support arms positioning the retention rod above and slightly in front of said stationary bar;

a guide member secured beneath said stationary bar intermediate its ends for limiting downward movement of the intermediate portion of the bar, said stationary bar and said retention rod extending beneath the contact leg members of at least 20 keys of said accompaniment playing keys;

said rod having a first position in which it engages said contact leg of a depressed accompaniment playing key and retains said accompaniment playing key depressed after the pressure from said instrument player is removed, and said rod having a second position in which it is pivoted out of the downward path of said leg members and permits unrestricted travel of the contact leg of a depressed accompaniment playing key;

a bias means connected to said rod for forcing said rod into said first position;

an electro-mechanical bistable control means which has an extending arm coupled to said retention rod, said extending arm having a normal position and a release position, for imparting pivotal motion through said arm to said retention rod; and the extending arm of said control means in said normal position forcing said rod to pivot into said second position and the extending arm of said control means in said release position allowing said bias means to force said rod to pivot into said first position so that when one or more of said accompaniment playing keys are substantially simultaneously depressed said contact leg of each depressed accompaniment playing key engages said retention rod and each said accompaniment playing key remains depressed.

2. An electro-mechanical memory device for use in a keyboard electronic musical instrument having a plurality of accompaniment chord and bass note playing keys and a plurality of melody playing keys both depressible by an instrument player and returnable to a horizontal position after the downward pressure from said instrument player is removed comprising:

a plurality of contact leg members each including a downwardly extending bracket, having a free end, attached beneath an associated one of said accompaniment playing keys and a tongue secured to the downwardly projected free end of the bracket, said tongue extending forwardly from said bracket;

a lower stationary bar rotatably mounted below said accompaniment playing keys;

a plurality of support arms spaced apart and attached to said stationary bar extending upwardly therefrom;

an upper retention rod attached to said support arms and extending parallel to said stationary bar, said support arms positioning the retention rod above and slightly in front of said stationary bar and below the tongues of undepressed keys;

said rod having a first position in which it engages the associated tongue of a depressed accompaniment playing key and retains said accompaniment playing key depressed after the pressure from said instrument player is removed, and said rod having a second position generally forward of said first position in which it is pivoted forward out of the downward path of said tongues and permits unrestricted travel of the said tongues of depressed accompaniment playing keys;

a bias means connected to said rod for forcing said rod to said first position;

an electro-mechanical bistable control means positioned rearward of said retention rod which has an extending arm and a link member attached to said extending arm, said extending arm having a forward normal position and a rearward release position, for imparting pivotal motion through said arm and said link member to said retention rod; and the extending arm causing said link member to bear against said retention rod to pivot the rod forward into its second position when the extending arm is in its said normal position, and the extending arm of said control means in said release position causing the link member essentially not to bear against said retention rod to allow the rod to pivot rearwardly into its first position, so that when one or more of said accompaniment playing keys are substantially simultaneously depressed the said tongue of each depressed accompaniment playing key engages said retention rod and each said accompaniment playing key remains depressed.

3. The device of claim 2 in which there are at least 20 contact leg members and which includes a guide member secured beneath said stationary bar intermediate its end for limiting downward movement of the intermediate portion of the bar.

4. An electro-mechanical memory device for use in an electronic organ having a plurality of accompaniment chord and bass note playing keys and a plurality of melody playing keys both depressible by an organ player and returnable to a horizontal position after the downward pressure from said organ player is removed comprising:

at least 20 contact leg members each including a downwardly extending bracket, having a free end, attached beneath an associated one of said accompaniment playing keys and a tongue secured in an essentially horizontal plane by a fastener to the downwardly projected free end of the bracket, said tongue extending forwardly from said bracket;

a lower elongated cylindrical stationary bar rotatably mounted in bushings attached to the organ, said lower stationary bar being positioned below said accompaniment playing keys;

a plurality of support arms spaced apart from one another and attached to said stationary bar extending generally parallel upwardly therefrom;

an upper elongated cylindrical retention rod attached to said support arms and extending parallel to said stationary bar, said support arms positioning the retention rod above and slightly in front of said stationary bar;

a guide member secured beneath said stationary bar intermediate its ends for limiting downward movement of the intermediate portion of the bar, said stationary bar and said retention rod extending beneath the contact leg members of at least 20 keys of said accompaniment playing keys;

said upper retention rod having a first position in which it engages the associated tongue of a depressed accompaniment playing key and retains said accompaniment playing key depressed after the pressure from said instrument player is removed, and said upper retention rod having a second position generally forward of said first position in which it is pivoted forward out of the forward path of said tongues and permits unrestricted travel of the said tongues of depressed accompaniment playing keys;

a bias spring means connected to said rod for forcing said rod into said first position;

a solenoid control means positioned rearward of said retention rod which has an extending arm and a link member attached to said extending arm, said extending arm having a forward normal position and rearward release position, for imparting pivotal motion through said arm and said link member to said retention rod; and the extending arm causing said link member to bear against said retention rod to pivot the rod forward into its second position when the extending arm of the solenoid means is in its said normal position, and the extending arm of said solenoid means in said release position causing the link member essentially not to bear against said retention rod to allow the retention rod to pivot rearwardly under the action of said bias spring means into its first position, so that when one or more of said accompaniment playing keys are substantially simultaneously depressed, the said tongue of each depressed accompaniment playing key engages said retention rod and each said accompaniment playing key remains depressed.

* * * * *